United States Patent [19]

Heinlein

[11] 4,347,766

[45] Sep. 7, 1982

[54] SHARPENER FOR STEEL EDGES OF SKIS

[76] Inventor: Hans Heinlein, Bahnhofstrasse 11-13, 8502 Zirndorf, Fed. Rep. of Germany

[21] Appl. No.: 242,820

[22] Filed: Mar. 11, 1981

Related U.S. Application Data

[63] Continuation of Ser. No. 749,521, Dec. 10, 1976, abandoned.

[30] Foreign Application Priority Data

Dec. 13, 1975 [DE] Fed. Rep. of Germany ..... 2556178
Dec. 7, 1976 [DE] Fed. Rep. of Germany ..... 2655342

[51] Int. Cl.[3] ..... A63C 11/06; B27G 17/04; B21K 17/00

[52] U.S. Cl. ..... 76/83; 76/88; 7/167; 30/169; 30/287

[58] Field of Search ..... 76/83, 88, 82, 82.1; 51/205 WG, 214, 181 R; 7/167; 280/809; 30/169, 293, 172, 287, 162; 81/15.2; 15/184; 206/372, 230, 349, 234, 45.2

[56] References Cited

U.S. PATENT DOCUMENTS

| | | | |
|---|---|---|---|
| 3,107,426 | 10/1963 | Robinson, Jr. | 30/162 |
| 3,555,679 | 1/1971 | Sheridan | 30/172 |
| 3,621,571 | 11/1971 | Gern | 30/169 |
| 3,681,806 | 8/1972 | Han | 51/181 R |
| 3,800,353 | 4/1974 | Roth | 15/184 |
| 3,990,147 | 11/1976 | Gill et al. | 30/293 |

*Primary Examiner*—Roscoe V. Parker
*Attorney, Agent, or Firm*—Browdy & Neimark

[57] ABSTRACT

A sharpener for steel edges of skis comprises a compact, inexpensive, portable holder containing a cutting plate and a guide pin. The cover for the holder can be positioned to serve as a handle. The cutting plate preferably forms an angle of less than 90° with the steel edge of the ski to be sharpened.

23 Claims, 7 Drawing Figures

SHARPENER FOR STEEL EDGES OF SKIS

This is a continuation of application Ser. No. 749,521, filed Dec. 10, 1976, now abandoned.

FIELD OF THE INVENTION

The invention relates to a sharpener for the steel edges of skis.

BACKGROUND OF THE INVENTION

Narrow steel edges with a rectangular cross section are generally set into the edges of the running surfaces of skis. These steel edges require resharpening from time to time. Sharpening machines are known for this purpose, but they can only be installed permanently, usually only in sporting goods shops or the like, because of their size and weight. In addition, files are known for sharpening the edges of skis, with which the steel edges can be touched up by hand. However, it is very difficult to produce perfect rectangular edges with such files.

SUMMARY OF THE INVENTION

Hence, the goal of the invention is to provide a sharpener for the steel edges of skis which is handy and light, so that it can be carried at all times by skiers and is so easy to use that the steel edges of the skis can be sharpened both on the bottom side and on the side edges, accurately and at right angles to one another, with no special care being required.

This goal is achieved according to the invention essentially by providing a holder with a cutting plate attached to the holder, and a guide pin mounted on the holder, essentially vertical to the holder.

It is particularly advantageous to make the holder in the shape of a box and to provide a cover part, adjustable on the holder, as a handle.

The device is simple to manufacture, if the holder and the cover are made circular or cylindrical.

In order to facilitate adjustment of the cover during its function as a cover for the cutting plate or as a handle during use, a circumferential support bead for the cover is provided on the holder.

It is particularly advantageous if rotating plates are used as cutting plates, whereby several cutting edges can be brought into position one after another in simple fashion by rotating the square rotating plate, without requiring regrinding.

The cutting plates are preferably made of wear-resistant cutting material, especially cutting alloy.

According to a preferred embodiment, the cutting plates are held in place by means of a clamp which can be fastened to the holder. Hence, a clamping cover can be held in place by a threaded bolt, which bolt can be screwed into a blind hole in the holder.

A hardened adapter pin, mounted in a blind hole on the holder by means of a press fit, serves as a guide pin.

The cutting plate is mounted with one cutting edge vertical to the holder, while the central plane of the cutting plate forms an angle preferably less than 90° with a line formed by the lower edge of the guide pin and the cutting edge.

In general, the threaded bolt for the clamping cover of the cutting plate can be screwed into a blind hole provided with a thread. To increase strength, it may be advantageous to form a nut in the edge of the blind hole when manufacturing the holder.

According to an especially advantageous embodiment of the invention, the cutting plate is held in place by means of a clamping and guide plate as well as a counter plate inside the holder, whereby the clamping plate and counter plate are held together by bolts. This ensures a reliable attachment of the cutting element, whereby the danger of tearing out or breaking off from the holder is reliably avoided.

According to a further embodiment of the invention, the cutting plate is provided with a double bevel. This ensures that spiral chips will be produced instead of individual chip fragments.

In another embodiment of the invention, the clamping plate is provided with lands opposite the bevels of the cutting plate to allow the chips to escape.

In order to prevent the device from sliding off at the end of a ski, according to a further embodiment of the invention a central guide roller is provided, the roller being rotatably fastened by means of a bolt.

Instead of the guide roller, according to a modification of the invention, at least one guide rib can be provided between the cutting plate and the guide pin. This guide rib serves to hold the device on the edge of the ski, thus avoiding additional installation effort, since the guide rib has already been shaped to the holder during manufacture.

In order to increase the useful value further, it is advantageous to mount a hex wrench on the inside of the holder at a central location by means of a bolt and a clamp in a groove. The hex wrench is used to loosen the inside edge bolts of the holding plates.

In a further embodiment of the invention, the cover is provided with bayonet recesses in the edge area, the recesses cooperating with locking pins on the holder. This bilaterally acting lock makes the device more convenient to use and prevents the cover from being pulled off inadvertently while sharpening the edges.

According to a modification of the invention, an especially wide edge area is provided as a handle for the holder, so that a separate cover can be eliminated.

At least one spare cutting plate is located inside the holder, according to another feature of the invention.

The holder and, if required, the cover as well can be manufactured from impact-resistant and weather-resistant material, low-pressure polyethylene for example.

Further features and advantages of the invention will be described in greater detail with reference to the drawing, which shows schematic preferred embodiments.

DESCRIPTION OF THE PREFERRED EMBODIMENTS

Figure 1:
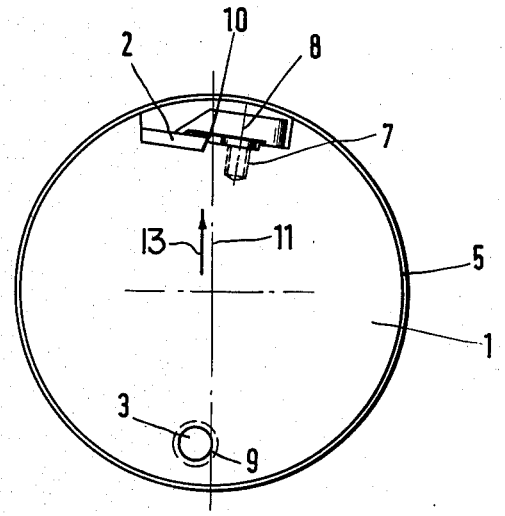
FIG. 1 is a top view of a first embodiment of a sharpener according to the invention.
Figure 2:
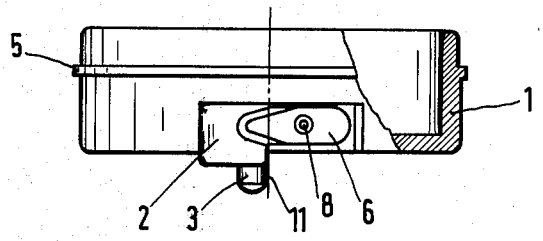
FIG. 2 is a side view of the device shown in FIG. 1, in partial cross section.

FIG. 1 shows a sharpener for the steel edges of skis according to the invention. In this embodiment, a holder 1 is provided, on which a cutting plate 2 and a guide pin 3 are mounted.

Holder 1 is made circularly cylindrical and is provided with a support bead 5 around its circumference. Cutting plate 2, preferably made in the form of a rotating plate, has one cutting edge 10 approximately perpendicular to the surface of holder 1 and is held in place by means of a clamp. A clamping cover 6 is fastened to holder 1 by a threaded bolt 8 which fits into a blind hole 7 with an internal thread. Cutting plate 2 consists of wear-resistant cutting material, preferably cutting alloy.

Guide pin 3 is mounted in a blind hole 9 of holder 1 by a press fit and preferably consists of a hardened adapter pin. Cutting plate 2 is mounted in such manner that its central plane forms an angle of less than 90° with a line 11 formed by its cutting edge 10 and the lower edge of guide pin 3. Line 11 therefore corresponds to the steel edge of a ski to be sharpened.

Figure 3:
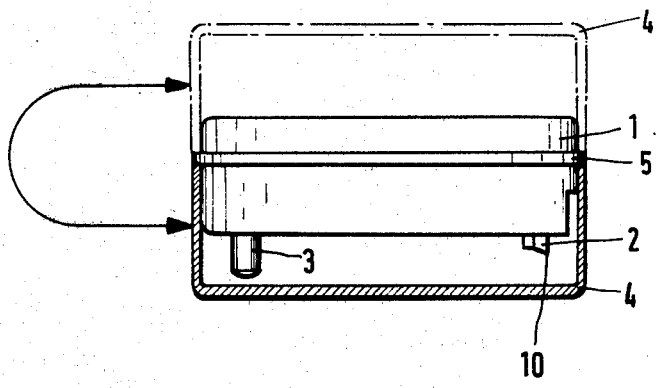
FIG. 3 is an embodiment with a cover.

As best shown in FIG. 3 a cover 4 is provided which is preferably made in the shape of a box or a hollow cylinder. Cover 4 can be adjusted on holder 1 in such manner that in one position, as shown in cross section in FIG. 3, it covers cutting plate 2 and guide pin 3, or, as shown by the dot-dash line, it serves as a handle when using the sharpener. The circumferential bead 5 serves as a support for cover 4.

Holder 1 and cover 4 are preferably made from impact-resistant plastic. As shown by the dashed lines in FIG. 1, blind holes 7 and 9 are provided on holder 1 to accept threaded bolt 8 and guide pin 3. The blind holes can be provided with reinforcing ribs 12 for reinforcement.

To use the device, after adjusting cover 4, the sharpener is placed on the steel edge, corresponding to line 11, contacting it with the lower edge of guide pin 3 and the cutting edge 10 of cutting plate 2. By smoothly sliding the device along the length of each steel edge in the direction of arrow 13, the steel edge is sharpened by cutting edge 10. By making a simple adjustment, the surface of the steel edge of the ski, displaced by 90°, can be sharpened in similar fashion.

If a known rotating plate is used as cutting plate 2, the user can employ another of the four cutting edges of cutting plate 2 by loosening threaded bolt 8 and rotating cutting plate 2. When all four cutting edges have been used, cutting plate 2 can be simply resharpened in known fashion.

Figure 4:
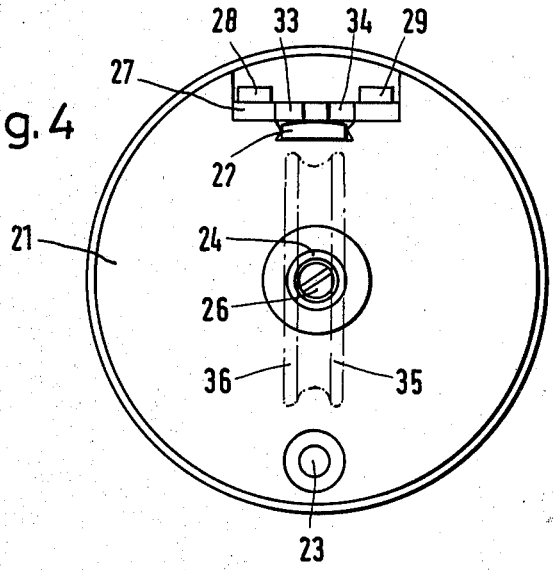
FIG. 4 is a top view of another embodiment of a sharpener according to the invention.
Figure 5:
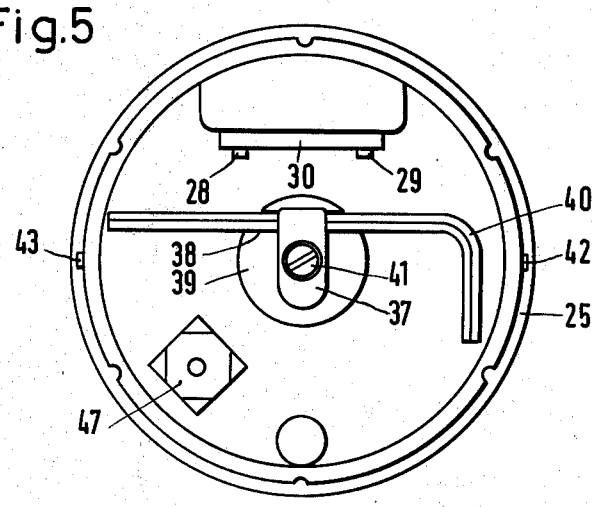
FIG. 5 is an inside view of the holder according to FIG. 4.

FIG. 4 shows another preferred embodiment of a sharpener for the steel edges of skis according to the invention. In this embodiment, a holder 21 is provided, with a cutting plate 22 and a guide pin 23. Holder 21 in this embodiment is made in the form of a circular cylinder, but can also be made oval or angular. It is provided with a circumferential bead 25 around its edge. Cutting plate 22, preferably made in the form of a rotating plate, has two cutting edges approximately perpendicular to the surface of holder 21, as best seen in FIGS. 4 and 5. It is held in place by a clamping and supporting plate 27 and a backing plate 30 inside holder 21. Clamping plate 27 and backing plate 30 are connected by means of hex cap bolts 28 and 29. A roller 24 is mounted centrally in holder 21 as a guide element. This roller 24 is fastened in a central portion 39 of holder 21 by a holder 26.

Figure 7:
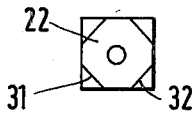
FIG. 7 is an end view of a preferred cutting element.

Cutting element 22 is advantageously provided with bevels 31 and 32, as best shown in FIG. 7, in order to produce spiral chips when used.

Grooves 33 and 34 are advantageously provided on clamping plate 27 opposite these bevels 31 and 32 to allow the chips to escape.

Instead of central guide roller 24, a guide rib 35 can be provided as shown by the dot-dash line in FIG. 4, which rib serves to support the device on the edge of the ski. In a further modification, two symmetrically located guide ribs 35 and 36 can be provided.

A hex wrench 40 is attached to the inside of holder 21 in an advantageous fashion to central part 39, as shown in FIG. 5. For this purpose, a groove 38 in central part 39 as well as a clamp 37 attached by means of a bolt 41 are used.

It is also evident from FIG. 5 that at least one spare cutting plate 47 is provided inside holder 21. It can be held in place by means of a clamp, a bolt, or another suitable device.

Figure 6:
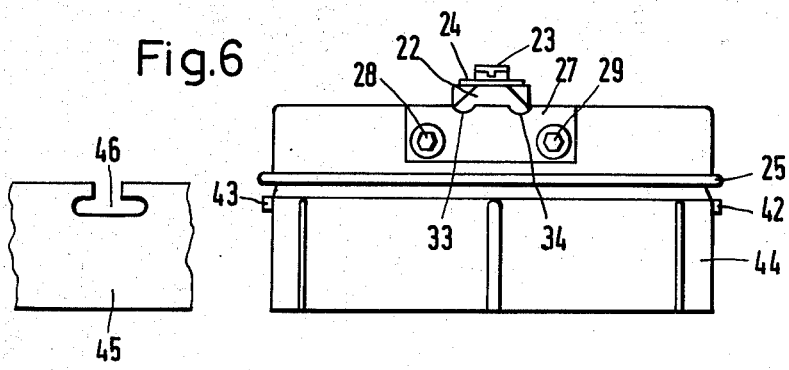
FIG. 6 is a side view with a partial cross section of the cover.

FIG. 6 is an end view of the embodiment according to FIG. 4. According to a further embodiment, locking studs 42 and 43 are provided on the circumference of supporting part 44, which fit into bilaterally acting bayonet locking openings 46 in a cover 45, shown only partially in FIG. 6.

According to a modification of the invention, edge part 44 can be made sufficiently wide that it can be used as a handle without cover part 45.

FIG. 7 shows a cutting plate 22 alone. The two bevels 31 and 32 are clearly visible.

The invention is not limited to the preferred embodiments shown and described. For example, holder 1 can also be made rectangular, oval, or the like, but the circular or box-shaped design considerably simplifies manufacture by the injection molding method. Instead of the circumferential support bead 5, supporting lugs or the like can be provided.

The holder according to the invention, and the cover part if required, are preferably made of impact-resistant and weather-resistant plastic, but can also be made of sheet metal, aluminum, or another appropriate material. It is particularly important that the device operate reliably even at low temperatures. Preferably the device is made of low-pressure polyethylene.

The invention includes all modifications and improvements made by experts, as well as partial and subcombinations of the features and measures described and/or shown.

I claim:

1. A sharpener for steel edges of skis, comprising:

a holder having a substantially flat planar surface for stable sliding contact with a ski surface;

a cutting plate having first and second cutting edges on opposed sides thereof, said plate being disposed on said holder such that said plate and both of said cutting edges thereof protrude from said flat surface; and guide means disposed on said holder and protruding from said flat surface substantially perpendicular thereto for guiding the edge of a ski disposed on said flat surface, when said ski edge is in contact with both said first cutting edge and one side of said guide means, such that an appropriate cutting angle is maintained at said first cutting edge when the sharpener is moved along the edge of the ski in a given cutting direction, and also for guiding the edge of a ski disposed on said flat surface, when said ski edge is in contact with both said second cutting edge and the other side of said guide means, such that an appropriate cutting angle is maintained at said second cutting edge when the sharpener is moved along the edge of the ski in a given cutting direction;

wherein said cutting plate and said guide means are so disposed with respect to said flat surface that a sufficient amount of said surface is present on both sides of a line connecting said cutting plate and said guide means to provide stable sliding contact with a ski surface when placed on either side of such line and in contact with both said cutting plate and said guide means.

2. A sharpener in accordance with claim 1 wherein the flat planar surface of said holder is circular and said holder further includes a cylindrical skirt extending from the edges of said flat surface in a direction opposite the direction of protrusion of said cutting plate and said guide means, said skirt being sufficiently long to serve as a grasping means for a user to hold the sharpener.

3. A sharpener in accordance with claim 1 wherein said guide means and said cutting plate are so disposed such that said first and second cutting edges are each in a respective plane whose line of intersection with the plane of said flat planar surface forms an angle of less than 90 degrees with the respective cutting direction.

4. A sharpener in accordance with claim 1 wherein said guide means is disposed trailing both said first and second cutting edges with respect to the cutting direction of the sharpener.

5. A sharpener in accordance with claim 1 wherein the flat planar surface of said holder is circular and said holder further includes a cylindrical skirt extending from the edges of said flat surface in a direction opposite the direction of protrusion of said cutting plate and said guide means; and further including a cylindrical cover part which is closed at one end for removably covering said flat planar surface means of said holder, as well as said cutting plate and said guide means protruding therefrom, when said cover is in the covering position.

6. A sharpener in accordance with claim 1, wherein said guide means comprises a pin fitted in and protruding from the flat surface of said holder.

7. A sharpener in accordance with claim 2 including a support bead provided circumferentially around said cylindrical skirt of said holder.

8. A sharpener in accordance with claim 1 wherein said cutting plate has a plurality of pairs of first and second cutting edges, different pairs of which can be placed into operative position by rotation of said cutting plate; and further including releasable clamp means connected to said holder for releasably clamping said cutting plate in place, such that said cutting plate can be released, rotated to place a different pair of first and second cutting edges in operative position, and reclamped when desired.

9. A sharpener in accordance with claim 8, wherein said holder further includes a skirt extending from the edges of said flat surface in a direction opposite to the direction of protrusion of said cutting plate and said guide means, thereby providing a hollow interior within said skirt and beneath said surface means; and further including wrench means for releasing said releasable clamp means; and wrench holder means within the interior of said holder for releasably securing said wrench means therein.

10. A sharpener in accordance with claim 5 wherein an edge area of the cylindrical portion of said cover includes bayonette recesses provided therein and wherein the cylindrical skirt of said holder includes locking means thereon cooperating with said bayonette recesses of said cover.

11. A sharpener in accordance with claim 1 wherein said cutting plate is substantially square with two cutting edges on each corner, thereby permitting four different pairs of first and second cutting edges to be placed in operative position by means of rotating said plate in increments of 90 degrees.

12. A sharpener in accordance with claim 1 wherein said holder further includes a skirt extending from the edges of said flat surface in a direction opposite to the direction of protrusion of said cutting plate and said guide means, thereby providing a hollow interior within said skirt and beneath said surface means; and further including a spare cutting plate releasably secured in the interior of said holder.

13. A sharpener in accordance with claim 6 wherein said pin is a hardened adapter pin and wherein said holder has a blind hole therein, said adapter pin being press-fitted in said blind hole.

14. A sharpener in accordance with claim 1 wherein said cutting plate is made of wear-resistant cutting material.

15. A sharpener in accordance with claim 8, wherein said releasable clamp means comprises a face of said holder cut away from said flat surface, a clamping cover having at least one hole therein and bolt means passing through said hole and into the face of said holder for releasably fastening said clamping cover into place.

16. A sharpener in accordance with claim 15 wherein said face of said holder has at least one blind hole therein, and said bolt means comprises at least one threaded bolt being srewable into said blind hole.

17. A sharpener in accordance with claim 15 wherein said clamp means further includes a guide plate behind said face of said holder and wherein said bolt means comprises a threaded bolt connecting said clamping cover and said guide plate.

18. A sharpener in accordance with claim 1 wherein said cutting plate is provided with bevelled edges.

19. A sharpener in accordance with claim 15 wherein said cutting plate is provided with bevelled edges and said clamping plate is provided with grooves opposite said bevelled edges to allow chips to escape.

20. A sharpener in accordance with claim 1 wherein said guide means comprises at least one guide rib.

21. A sharpener in accordance with claim 6 wherein said guide means further includes at least one guide rib being disposed between said cutting plate and said guide pin.

22. A sharpener in accordance with claim 1 wherein said guide means includes a central guide roller rotatably connected to the flat surface of the holder.

23. A sharpener in accordance with claim 1 wherein said holder is made of impact-resistant and weather-resistant material.

* * * * *